US007066219B2

(12) United States Patent
Poldervaart et al.

(10) Patent No.: US 7,066,219 B2
(45) Date of Patent: Jun. 27, 2006

(54) HYDROCARBON FLUID TRANSFER SYSTEM

(75) Inventors: Leendert Poldervaart, La Turbie (FR); Jack Pollack, Houston, TX (US)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 11/172,782

(22) Filed: Jul. 5, 2005

(65) Prior Publication Data

US 2005/0241729 A1 Nov. 3, 2005

Related U.S. Application Data

(62) Division of application No. 10/485,964, filed as application No. PCT/EP02/08795 on Aug. 6, 2002, now Pat. No. 6,923,225.

(30) Foreign Application Priority Data

Aug. 6, 2001 (EP) ..... 01202973

(51) Int. Cl.
*B65B 1/04* (2006.01)

(52) U.S. Cl. ..... 141/387; 141/279; 114/230.15; 441/5

(58) Field of Classification Search ..... 141/279, 141/387, 388; 114/230.15, 230; 441/3, 441/4, 5

See application file for complete search history.

(56) References Cited

U.S. PATENT DOCUMENTS

| | | | | |
|---|---|---|---|---|
| 4,099,542 | A | 7/1978 | Gibbons | |
| 4,351,260 | A | 9/1982 | Tuson et al. | |
| 4,530,302 | A | 7/1985 | Pedersen | |
| 4,606,294 | A | 8/1986 | Di Tella et al. | |
| 4,669,412 | A | 6/1987 | Pollack | |
| 6,851,994 | B1 | 2/2005 | Boatman et al. | |
| 6,923,225 | B1 * | 8/2005 | Poldervaart et al. | 141/387 |

FOREIGN PATENT DOCUMENTS

| | | |
|---|---|---|
| EP | 0 105 976 | 4/1984 |
| FR | 2 367 654 | 5/1978 |
| WO | WO 99 48752 | 9/1999 |
| WO | WO 99 50173 | 10/1999 |

* cited by examiner

*Primary Examiner*—Steven O. Douglas
(74) *Attorney, Agent, or Firm*—Young & Thompson

(57) ABSTRACT

The invention relates to a fluid transfer system, in particular for LNG in which an articulated vertical and horizontal mooring arm are suspended from a support on the processing vessel. Independently moveable ducts, for instance cryogenic hard piping are placed parallel to the mooring arms such that a transfer system is obtained in which is the mooring forces are insulated from the fluid transfer line with which rapid connection and disconnection is possible and which provides a large yaw resistance. In a preferred embodiment, the mooring system comprises two vertical arms connected to a triangular horizontal yoke attached to the bow of the LNG-carrier for improved yaw resistance.

19 Claims, 7 Drawing Sheets

HYDROCARBON FLUID TRANSFER SYSTEM

This application is a division of co-pending application Ser. No. 10/485,964, filed on Jul. 8, 2004. application Ser. No. 10/485,964 is the national phase of PCT International Application No. PCT/EP02/08795 filed on Aug. 6, 2002 under 35 U.S.C. § 371, which claims priority of European Application No. 01202973.2 filed Aug. 6, 2001. The entire contents of each of the above-identified applications are hereby incorporated by reference.

The invention relates to a hydrocarbon transfer system comprising a processing vessel and a tanker vessel, having a longitudinal axis, a transverse axis and a vertical axis, the tanker vessel being moored to the processing vessel via a mooring device comprising a support structure on one of the vessels, a substantially vertical first arm suspended from the support structure and a substantially horizontal second arm with a coupling end part which is connected to the other of the vessels via a mechanical connector comprising an articulation joint allowing rotation of the second arm relative to the connector around a longitudinal axis, a transverse axis and a vertical axis, the second arm being with a- restoring end part connected to a lower end part of the first arm in an articulation joint allowing rotation of the second arm around a transverse axis, the restoring end part of the second arm and/or the end part of the first arm comprising a counterweight.

Such a hydrocarbon transfer system, in particular for offloading liquefied natural gas (LNG) from a processing vessel, such as an FPSO, to a shuttle tanker, is known from International Patent Application number PCT/EP99/01405 in the name of the applicant. In the known transfer system, the mooring device comprises two arms and seven swivel joints to provide the required degrees of freedom for pitch, roll and yaw of both vessels. A LNG transfer duct, comprising flexible elements, such as metal bellows, is placed inside the hollow mooring boom, for transfer of cryogenic fluids from the processing vessel to the shuttle tanker. The known integrated structure of mooring arms and transfer ducts is relatively complex as the swivels and the cryogenic transfer ducts need to transfer a part of the mooring loads, and therefore need to be relatively heavy and large sized. Maintenance and repair or change out of for instance a swivel, is therefore difficult and time consuming. A tandem offloading system with the known transfer construction furthermore has a limited yaw stiffness, which may result, under certain sea states, in too low a restoring momentum for counteracting the yaw of the shuttle tanker with regard to the FPSO.

It therefore is an object of the present invention to provide a reliable and simple transfer system, in particular for tandem offloading, which can have a light and simple hydrocarbon transfer duct and which avoids mooring forces exerted on the transfer duct. It is a further object to provide a transfer system, in particular a LNG transfer system, which is easy to maintain and/or repair. It is another object of the invention to provide a transfer system which allows safe operation and which maintains a controlled distance between the two vessels, avoiding collisions. It is again an object of the invention to provide a transfer system in which the fluid lines can be easily connected to the shuttle tanker.

Hereto the transfer system according to the invention is characterised in that a fluid transfer line is connected to and supported by the mooring device comprising a first transfer line part extending along the first arm and a second transfer line part extending along the second arm, the second transfer line part being connected to the second arm at or near the mechanical connector and comprising a fluid connector, wherein the fluid transfer line is supported at or near the support structure and at or near the mechanical connector, the fluid transfer line not being rigidly connected to the first and second arms at or near the lower end part and the restoring end part of said arms.

By placing a separate fluid transfer line along the mooring arms, mooring forces on the fluid transfer line are avoided. Because the fluid transfer lines, which may be flexible hoses, hard piping or combinations thereof, are not rigidly connected to the articulated connection point of the mooring arms, the flow lines can move independently of the mooring arms, and force transmission from the mooring structure to the fluid transfer lines is prevented. As the fluid transfer lines are connected to the substantially horizontal mooring arm near the mechanical connector, the end parts of the fluid transfer lines are placed in the proper position for attachment to a pipe system on the shuttle vessel, upon mooring. In a second step, after attaching the mechanical connector, the fluid connector can be attached. Furthermore, the fluid lines can move together with the mooring arms upon yaw movements of the vessels.

The fluid transfer lines according to the present invention can be relatively lightweight and may be detached for repair or maintenance while the mooring configuration is maintained.

Also thermally induced expansion and contraction, which is particularly a problem with cryogenic transfer lines such as LNG transfer lines, is possible without being restricted by the mooring arm. With "rigidly connected" as used herein, it is intended to mean a construction in which the fluid transfer line is connected to the arms by means of a fixed connection such as nuts and bolts, welding or tight steel cables such that independent movement of arms and transfer line is not possible, in particularly thermally induced expansion and contraction. An example of a fluid transfer line which is not rigidly connected is a fluid transfer line which is freely suspended on one end at the support structure and is connected to the arms at the coupling end part, or a fluid transfer line which is suspended from the arms by means of cables.

It should be noted that a tandem offloading system for LNG using a triangular yoke connecting the stern of a FPSO vessel to a bow on the shuttle tanker is known from WO99/38762. A flexible flow line is suspended from a vertical support arm and extends with a loop from the FPSO to the shuttle tanker. Even though the mooring forces are not transmitted to the flow line, the mooring arrangement fails to provide a restoring force upon an excursion of the vessels, and the resistance against yaw movements is slight. Attachment of the flexible fluid transfer line to the shuttle vessel needs to be effected separately after establishing mechanical connection. Furthermore, the loosely looped flexible flow line has as a disadvantage that the flexible flow line can buckle upon approach of the vessels which for cryogenic flexible lines may lead to damage to the flow line.

From WO99/35031 it is known to provide a LNG transfer boom between a platform and a vessel, wherein two articulated arms are used each carrying a rigid pipe. At the articulation joint of the arms, the pipes are interconnected via a flexible pipe segment arranged in a loop. Upon articulation of the arms, the flexible segment accommodates the different angular positions of the rigid pipes. At the connecting end of the arm a fluid connector is provided for coupling to a shuttle tanker. No mooring function is present in the transfer boom according to the prior art reference, the articulating arms forming a reinforcing support for the cryogenic transfer lines.

Finally, soft yoke mooring configurations in which a hinging arm is used in combination with a restoring counterweight for mooring a vessel to a tower or a buoy is described in several patents such as U.S. Pat. No. 4,568,295, U.S. Pat. No. 4,534,740 or U.S. Pat. No. 4,917,038 in the name of the applicant.

In an embodiment of the mooring system according to the present invention, the second transfer line part is connected to the first transfer line part in an articulation joint at or near the restoring end of the second arm, allowing rotation around a transverse axis, the second transfer line part being attached to the mechanical connector via an articulation joint allowing rotation of the second transfer line part relative to the connector around a longitudinal, a transverse and a vertical axis, the fluid connector being attached to the mechanical connector.

Via the articulation joints, the transfer line parts can follow the movements of the mooring arms independently and without being attached to the mooring arms along their length. Multiple transfer lines can be employed in parallel, each transfer line being attached to the mechanical connector. In a preferred embodiment the transfer line parts comprise rigid pipes that are suspended from the support structure from one end and are connected to the mechanical connector with their coupling end parts. Preferably, the transfer lines are cryogenic transfer lines with properly insulated parts and integrated or separate vapour return ducts.

In an embodiment, the mooring device comprises two spaced apart first arms, which at a top end are connected to the support structure in an articulation joint to be rotatable around a longitudinal and a transverse axis, two second arms being connected to the respective first arms in an articulation joint near the lower ends to be rotatable relative to the first arms around a longitudinal, a transverse and a vertical axis, the two second arms being attached to the mechanical connector.

The mooring system provides a large yaw stiffness by the two spaced apart mooring arms and the counterweights providing a restoring moment upon yaw displacement of the carrier or shuttle tanker. The mooring system may be used in combination with separate flexible flow lines, hard piping combinations of flexible hoses and hard piping or integrated systems such as described in PCT/EP99/01405. The counterweights at the restoring end of the substantially horizontal mooring arm also functions in uprighting the mooring arm upon disconnection of the mechanical connector. The counterweights may be placed at the end of an arm or below water level, suspended from a cable or chain.

The invention will be explained in detail with reference to the accompanying drawings. In the drawings.

Figure 1:
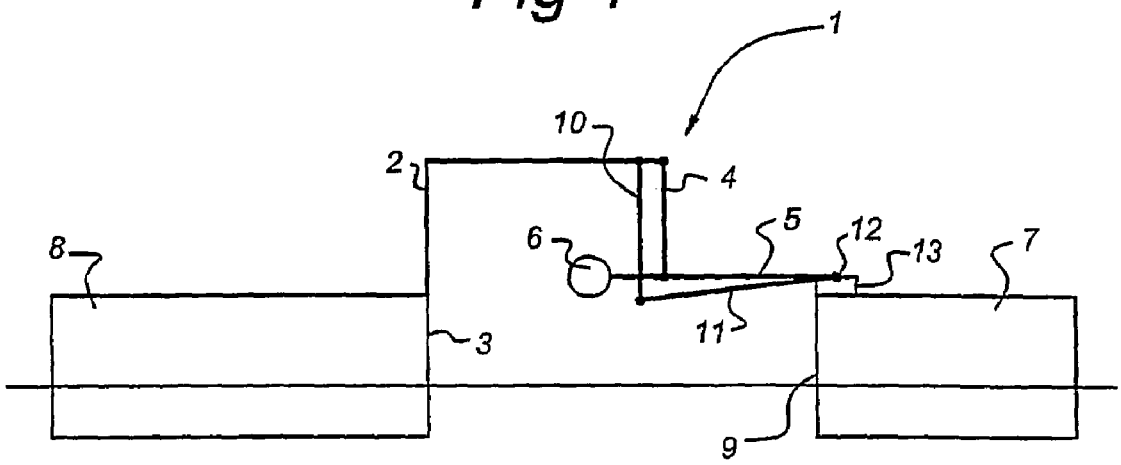
FIG. 1 shows a schematic side view of the cryogenic transfer system for tandem offloading according to the present invention.

FIG. 1 schematically shows the hydrocarbon transfer system 1 of the present invention comprising a support structure 2 placed at the stern 3 of a FPSO barge. From the support structure 2, a first vertical arm 4 is suspended and is connected to a substantially horizontal second arm 5. At a restoring end, a counterweight 6 is connected to the arm 5, which at a coupling end is provided with a mechanical connector 13 for attaching to the bow 9 the LNG-carrier 7. Parallel to the mooring arms 4, 5 cryogenic fluid transfer lines 10, 11 are placed, which are suspended on one side from the support structure 2 and which on the other side are connected in an articulation joint 12 to the mechanical connector 13 of the mooring arm 5. By connecting the flow lines to the mechanical connector, a rapid connection is possible and also a rapid release during emergency situations. However, the transfer line 11 may at its end be connected to the arm 5 instead of to the mechanical connector. The end of transfer line 11 is provided with a fluid connector for connecting to the pipe system of the LNG-carrier 7 after mechanical connection. The dimensions indicated in FIG. 1 are indicative for the order of magnitude of the mooring and transfer system of the present invention by way of illustrative example.

Figure 2:
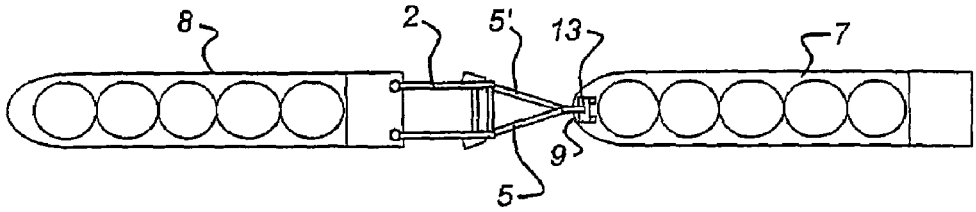
FIG. 2 shows a top view of the transfer system of FIG. 1.
Figure 3:
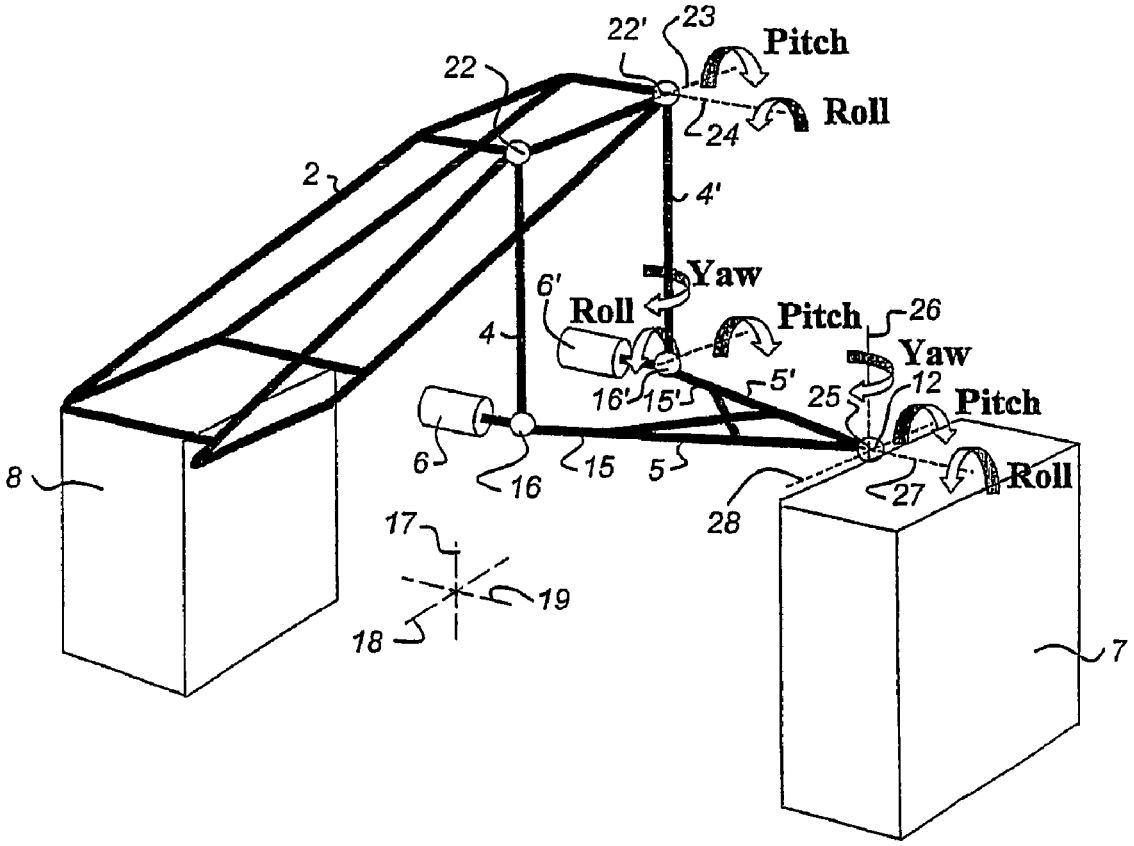
FIG. 3 shows a schematic perspective view of the mooring construction of the present invention.

FIG. 2 shows a top view of the FPSO 8 and LNG-carrier 7, the support structure 2, the horizontal mooring arms 5, 5' and the mechanical connector 13. As can be seen from FIG. 3, the horizontal mooring arms 5, 5' are with their restoring end parts 15, 15' connected to a respective vertical arm 4, 4' via articulation joints 16, 16'. Two counterweights 6, 6' are connected to the restoring end parts 15, 15' of each arm 5, 5'. The articulation joints 16, 16' may for instance comprise three perpendicular circular bearings, or ball-joints allowing rotation around a vertical axis 17 (yaw), a transverse axis 18 (pitch) and a longitudinal axis 19 (roll).

The vertical mooring arms 4, 4' are at their upper ends connected to the support structure 2 in articulation joints 22, 22' allowing rotation of the arms 4, 4' around a transverse axis 23 and a longitudinal axis 24. At the coupling end part 25, the arms 5, 5' are provided with the mechanical connector 13 allowing rotation around a vertical axis 26 (yaw), a longitudinal axis 27 (roll) and a transverse axis 28 (pitch). The mechanical connector is not shown in detail but may be formed by a construction such as described in U.S. Pat. No. 4,876,978 in the name of the applicant, which is incorporated herein by reference.

Figure 4:
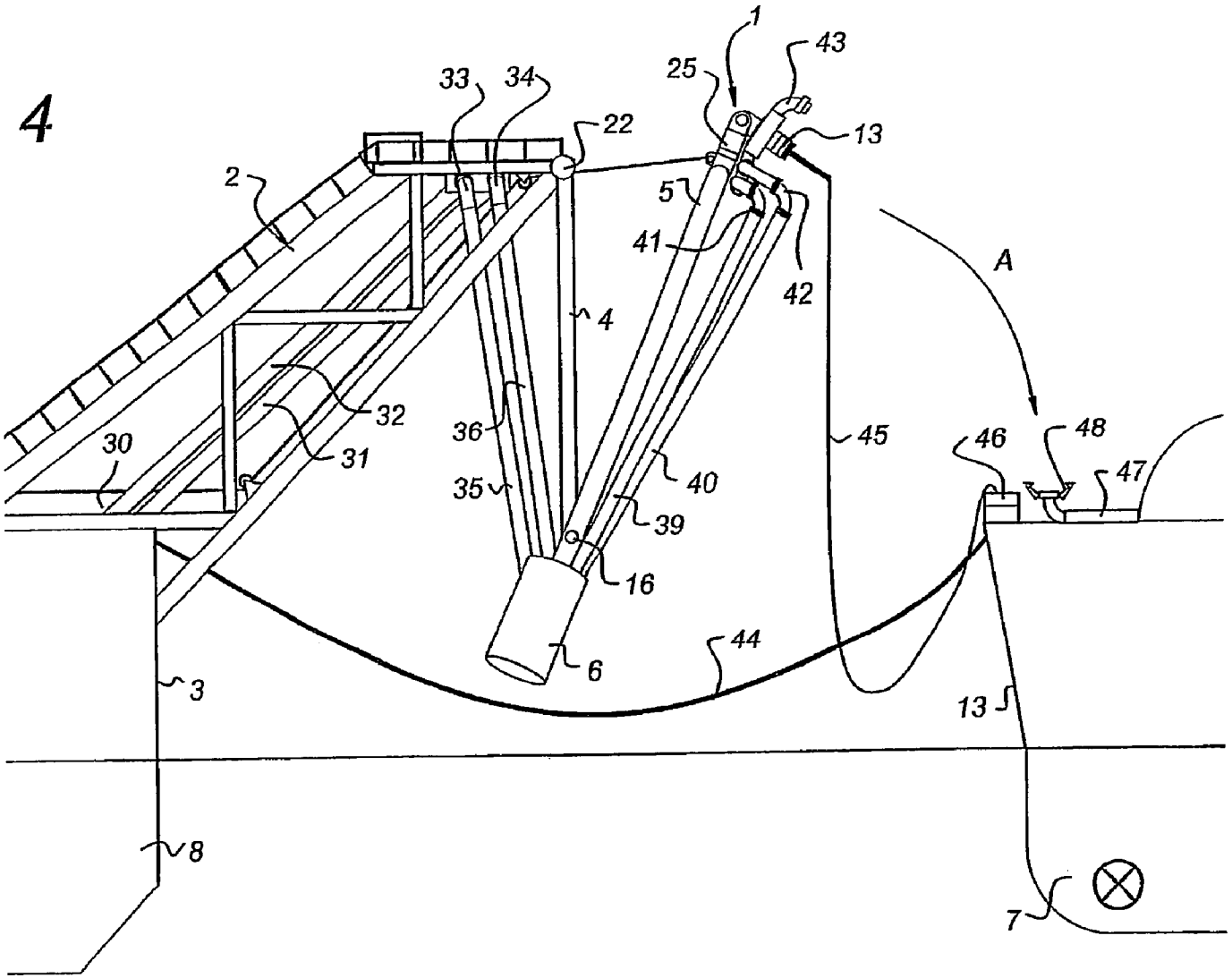
FIG. 4 shows a side view of the mooring arms and transfer pipes prior to coupling of the mechanical and fluid connectors.

FIG. 4 shows the transfer system 1 in which the mooring arms 5 are placed in a substantially vertical position via a cable 30 attached to the coupling end part 25 of the arms 5, 5' and connected with its other end to a winch (not shown) on the FPSO 8. Two rigid pipes 31, 32 extend from the FPSO 8 to a swivel connection 33, 34 on the support structure 2. From the swivel connections 33, 34 two vertical pipes 35, 36 extend downwardly to swivel connections 37, 38 (see FIG. 5). Two horizontal cryogenic transfer pipes 39, 40 extend along the arms 5, 5' to swivel connections 41, 42 on the mechanical connector 13. A fluid connector 43 is provided on the mechanical connector 13.

During connecting of the mooring arms 5, 5' to the bow 9 of the LNG-carrier 7, the vessels are connected via a hawser 44. Via a pilot line 45, the mechanical connector 13 can be lowered and placed into a receiving element 46 on deck of the LNG-carrier 7. By paying out cable 30, the horizontal arm 5 pivots in articulation joints 16, 16' around the transverse axis 18. The vertical ducts 35, 36 can pivot around a transverse axis 23 in articulation joints 33, 34 and in articulation joints 37, 38 as shown in FIG. 5 to assume a substantially vertical position.

Figure 5:
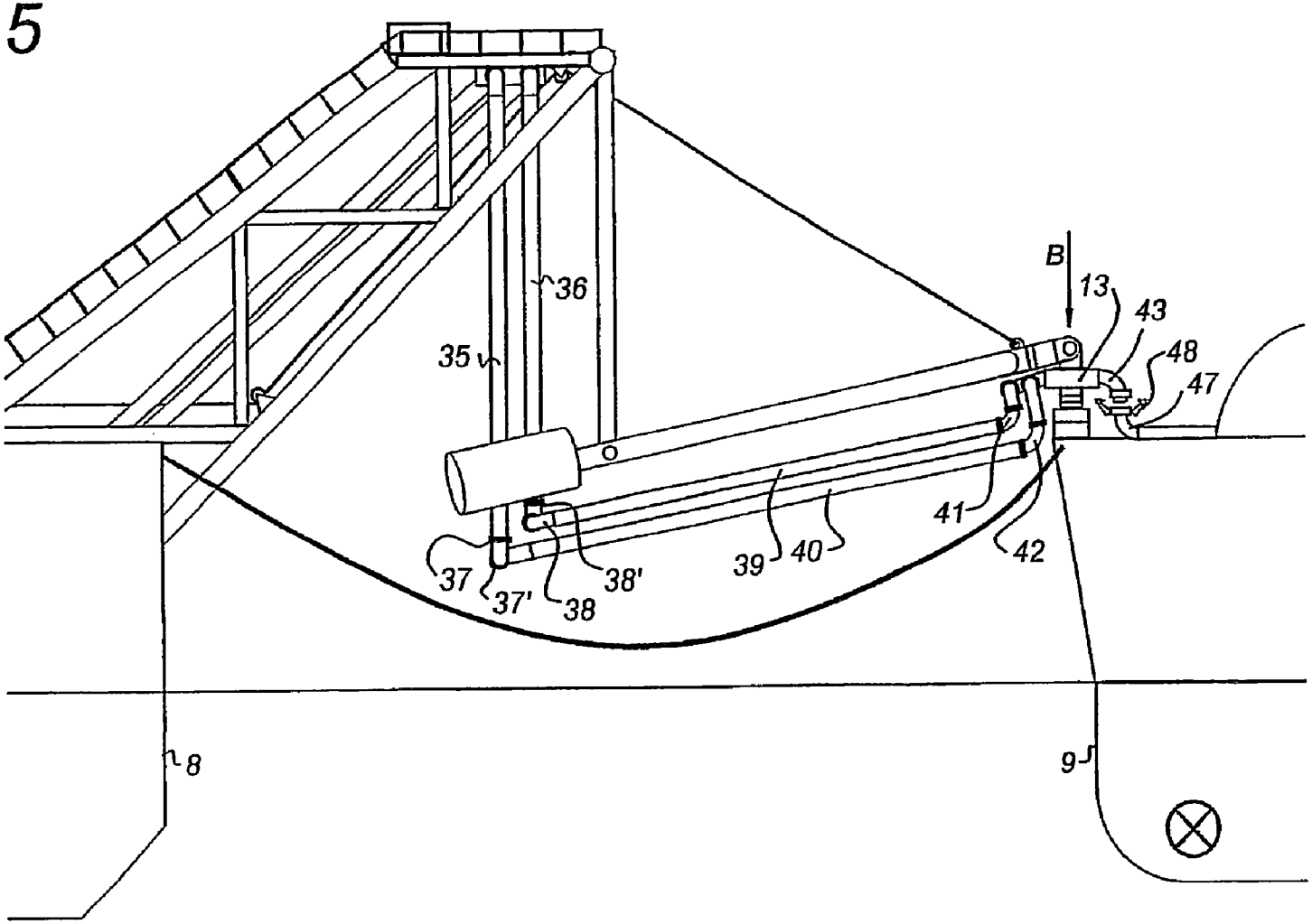
FIG. 5 shows the transfer system of FIG. 4 wherein the mooring arms are attached via the mechanical connector.
Figure 6:
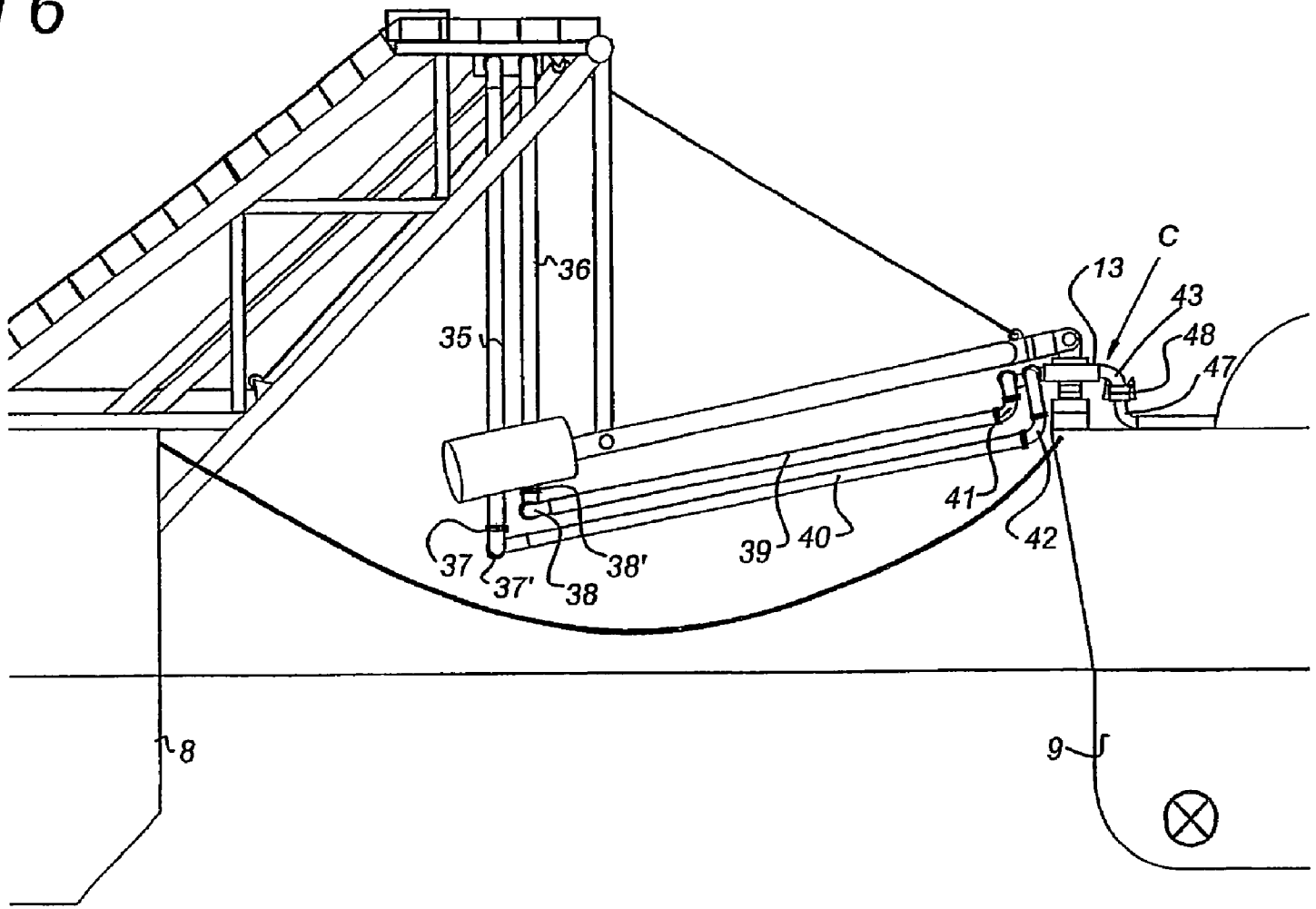
FIG. 6 shows attachment of the fluid connector of the transfer lines.

The horizontal ducts 39, 40 will also pivot around a vertical axis at swivels 37', 38' and around a transverse axis, a horizontal axis, and a vertical axis at the position of two sets of each three perpendicular swivels 41, 42 until the mechanical connector 13 mates with receiving element 46 as shown in FIG. 5. After locking the mechanical connector 13, the fluid connector 43 is attached to piping 47 on deck of the LNG-carrier 7 by raising said piping and engaging clamps 48 such as shown in FIG. 6.

Figure 7:
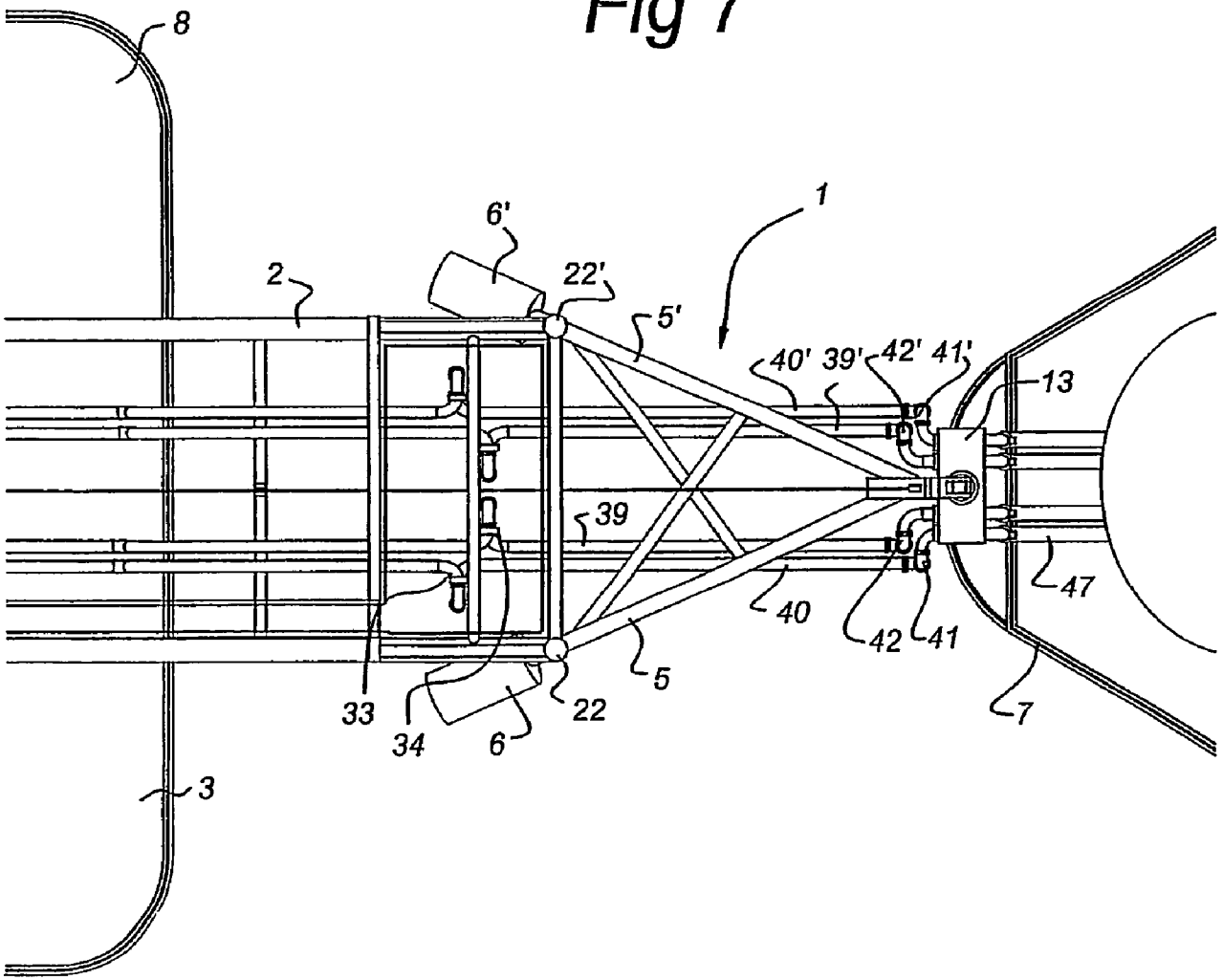
FIG. 7 shows a top view of the transfer system of FIG. 4-6.

FIG. 7 shows a top view of the transfer system 1 in the connected state showing four pipes 39, 39', 40, 40' attached to the mechanical connector 13. The transfer pipes 35, 36 are connected to the support structure 2 in articulation joints 33, 34 and can pivot around a substantially longitudinal axis. The pipes 39, 39', 40, 40' are connected to the mechanical connector 13 in articulation joints 41, 41', 42, 42' and can pivot around a longitudinal, a transverse and a vertical axis. The pipes can move independently of the mooring arms 4, 4', 5, 5'. During yaw-movements of the FPSO 8 or LNG-carrier 7, a good control and sufficient yaw-stiffness is achieved by the arms 5, 5' connected to the counterweights 6, 6'. Yaw displacement (in the horizontal plane) of the LNG-carrier will be counteracted by a restoring moment created by the counterweights 6, 6'. By separating the mooring function and the fluid transfer function, a simplified and proven cryogenic transfer system can be achieved using state of the art components and resulting in reduced and simplified maintenance.

Figure 8:
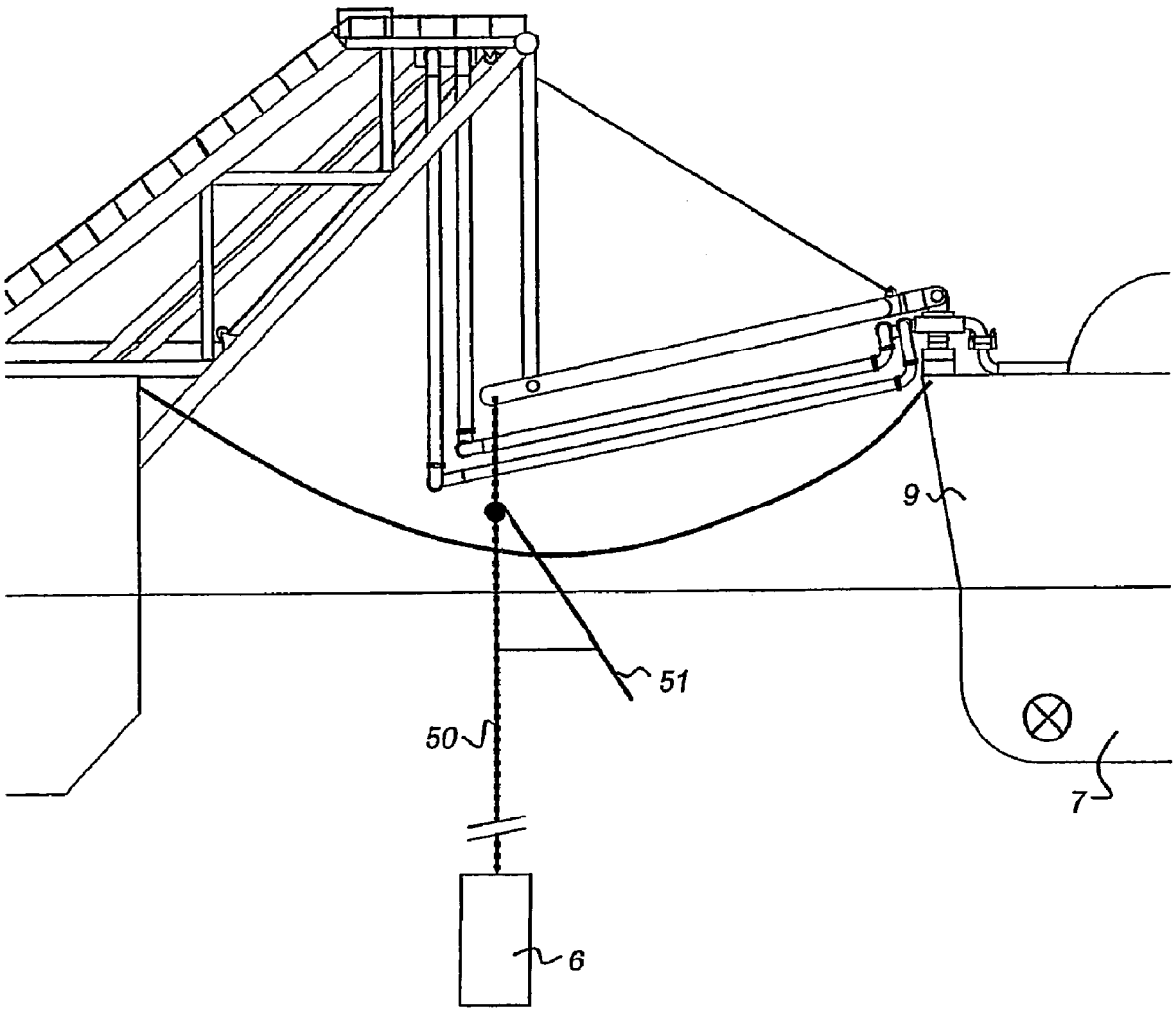
FIG. 8 shows an alternative embodiment of the counterweight of the mooring arms.

As shown in FIG. 8, the counterweights 6 may be suspended from a cable 50 such that movements of the counterweights 6 are damped below water level. A fender 51 may be applied on cable 50 for the counteracting movement of the vessel 7 towards vessel 8 upon lifting of the mooring system 1 to the configuration as shown in FIG. 4. When the bow 9 of the vessel 7 contacts the fender 51, the tension in the chain 50 will exert a restoring force on the vessel.

The fender system described above could be a fender system as described in U.S. Pat. No. 4,817,552 in the name of the applicant. The counterweights 6, 6' can be formed by clumpweights, flushable tanks, buoyancy elements and other constructions generally employed in soft yoke mooring systems. Even though the invention has been described in relation to hard piping 35, 35', 36, 36', 39, 39' and 40, 40' in combination with pipe swivels at articulation joints 33, 34, 41, 42, also flexible hoses or combinations of flexible hoses and hard piping, and ball-joints instead of pipe swivels can be employed. An example of a ball-joint suitable for cryogenic fluid transfer has been described in WO00/39496, which is incorporated herein by reference.

The invention claimed is:

1. Hydrocarbon transfer structure having a longitudinal axis, a transverse axis and a vertical axis comprising a vessel (8) moored to a mooring point via a mooring device, which mooring device comprises a support structure (2) on the vessel (8), two spaced apart substantially vertical arms (4,4') being at a top end attached to the support structure (2) in an articulation joint (22,22') to be rotatable around a longitudinal axis (24) and a transverse axis (23), two substantially horizontal arms (5,5') being connected to respective vertical arms (4,4') in an articulation joint (16,16') near the lower ends thereof to be rotatable relative to the first arms around a longitudinal (19) and a transverse (18) axis, the two arms (5,5') being rotatable around a vertical axis (17) and carrying at a coupling end part (25) a mechanical connector (13) comprising an articulation joint allowing rotation of the substantially horizontal arms (5,5') relative to the connector (13) around a longitudinal axis (27), a transverse axis (28) and a vertical axis (26), a counterweight (6) being attached to the restoring end part of the substantially horizontal and/or the vertical arms, characterised in that, the mooring point is placed on a second vessel (7), the substantially vertical and horizontal arms (4,4';5,5') being located above water level, wherein the mooring device comprises displacement means (30) acting on the substantially horizontal arms (5,5') for raising or lowering the arms (5,5') and a guide element (45) for guiding the connector (13) to the a connecting position on the vessel (7) upon connecting and disconnecting of the connector (13), wherein first ends of the two arms (5, 5') are, near the articulation joints (16, 16'), spaced apart and wherein second ends of the two arms (5, 5') are mutually connected at or near, the mechanical connector (13, 13') to form a delta-shaped frame.

2. Hydrocarbon transfer system (1) according to claim 1, comprising a fluid transfer line (35, 36, 39, 40) which is connected with a first end to the processing vessel (18) and with a second end to the tanker vessel (7) without being attached to the vertical first arm (4, 4') and to the part of the second arms (5, 5') located between the restoring end part and the mechanical connector (13).

3. Hydrocarbon transfer system (1) according to claim 2, wherein the transfer lines are cryogenic transfer lines.

4. Hydrocarbon transfer system according to claim 1, wherein the vertical arms (4, 4') are suspended from a support structure (2) which extends outboard from the processing vessel (8), the distance between the arms (4, 4') being smaller than the width of the processing vessel (8), the counter weight being spaced at a predetermined distance from the hull of the processing vessel (8).

5. Hydrocarbon transfer system (1) according to claim 1, wherein the counterweight (6, 6') is located below water level.

6. Hydrocarbon transfer system (1) according to claim 1, characterized in that, a fluid transfer line (35, 36, 39, 40) is connected to and supported by the mooring device comprising a first transfer line part (35, 36) extending along the first arm (4,4') and a second transfer line part (39, 40) extending along the second arm (5, 5'), the second transfer line part (35, 36) being connected to the second arm at or near the mechanical connector (13) and comprising a fluid connector (43), wherein the fluid transfer line is supported at or near the support structure (2) and at or near the mechanical connector (13), the fluid transfer line not being rigidly connected to the first and second arms (4, 4', 5, 5') at or near the lower end part (15, 15') and the restoring end part of said arms.

7. Hydrocarbon transfer system (1) according to claim 6, wherein the second transfer line part (39, 40) is connected to the first transfer line part (35, 36) in an articulation joint (37, 38) at or near the restoring end (15, 15') of the second arm (5, 5'), allowing rotation around a transverse axis, the second transfer line part (39, 40) being attached to the mechanical connector (13) via an articulation joint (41, 42) allowing rotation of the second transfer line part relative to the connector around a longitudinal, a transverse and a vertical axis, the fluid connector (43) being attached to the mechanical connector (13).

8. Hydrocarbon transfer system (1) according to claim 6, wherein at least two transfer lines (31, 32, 35, 36, 39, 40) are placed adjacent and mutually parallel, each transfer line being attached to the mechanical connector (13).

9. Hydrocarbon transfer system (1) according to claim 6, wherein the transfer line parts (35, 36, 39, 40) comprise rigid pipes, the first transfer line part being connected to the support structure (2) via an articulation joint (33, 34) allowing rotation of the first transfer line (35, 36) part around a transverse axis relative to the support structure (2).

10. Hydrocarbon transfer system (1) according to claim 9, wherein the transfer line parts (35, 36, 39, 40) that are located between the support structure (2) and the mechanical connector (13) are not connected to the arms (4, 4', 5, 5') of the mooring device.

11. Hydrocarbon transfer system according to claim 2, wherein the vertical arms (4, 4') are suspended from a support structure (2) which extends outboard from the processing vessel (8), the distance between the arms (4, 4') being smaller than the width of the processing vessel (8), the counter weight being spaced at a predetermined distance from the hull of the processing vessel (8).

12. Hydrocarbon transfer system according to claim 3, wherein the vertical arms (4, 4') are suspended from a support structure (2) which extends outboard from the processing vessel (8), the distance between the arms (4, 4') being smaller than the width of the processing vessel (8), the counter weight being spaced at a predetermined distance from the hull of the processing vessel (8).

13. Hydrocarbon transfer system (1) according to claim 2, characterized in that, a fluid transfer line (35, 36, 39, 40) is connected to and supported by the mooring device comprising a first transfer line part (35, 36) extending along the first arm (4,4') and a second transfer line part (39, 40) extending along the second arm (5, 5'), the second transfer line part (35, 36) being connected to the second arm at or near the mechanical connector (13) and comprising a fluid connector (43), wherein the fluid transfer line is supported at or near the support structure (2) and at or near the mechanical connector (13), the fluid transfer line not being rigidly connected to the first and second arms (4, 4', 5, 5') at or near the lower end part (15, 15') and the restoring end part of said arms.

14. Hydrocarbon transfer system (1) according to claim 3, characterized in that, a fluid transfer line (35, 36, 39, 40) is connected to and supported by the mooring device comprising a first transfer line part (35, 36) extending along the first arm (4,4') and a second transfer line part (39, 40) extending along the second arm (5, 5'), the second transfer line part (35, 36) being connected to the second arm at or near the mechanical connector (13) and comprising a fluid connector (43), wherein the fluid transfer line is supported at or near the support structure (2) and at or near the mechanical connector (13), the fluid transfer line not being rigidly connected to the first and second arms (4, 4', 5, 5') at or near the lower end part (15, 15') and the restoring end part of said arms.

15. Hydrocarbon transfer system (1) according to claim 4, characterized in that, a fluid transfer line (35, 36, 39, 40) is connected to and supported by the mooring device comprising a first transfer line part (35, 36) extending along the first arm (4,4') and a second transfer line part (39, 40) extending along the second arm (5, 5'), the second transfer line part (35, 36) being connected to the second arm at or near the mechanical connector (13) and comprising a fluid connector (43), wherein the fluid transfer line is supported at or near the support structure (2) and at or near the mechanical connector (13), the fluid transfer line not being rigidly connected to the first and second arms (4, 4', 5, 5') at or near the lower end part (15, 15') and the restoring end part of said arms.

16. Hydrocarbon transfer system (1) according to claim 5, characterized in that, a fluid transfer line (35, 36, 39, 40) is connected to and supported by the mooring device comprising a first transfer line part (35, 36) extending along the first arm (4,4') and a second transfer line part (39, 40) extending along the second arm (5, 5'), the second transfer line part (35, 36) being connected to the second arm at or near the mechanical connector (13) and comprising a fluid connector (43), wherein the fluid transfer line is supported at or near the support structure (2) and at or near the mechanical connector (13), the fluid transfer line not being rigidly connected to the first and second arms (4, 4', 5, 5') at or near the lower end part (15, 15') and the restoring end part of said arms.

17. Hydrocarbon transfer system (1) according to claim 7, wherein at least two transfer lines (31, 32, 35, 36, 39, 40) are placed adjacent and mutually parallel, each transfer line being attached to the mechanical connector (13).

18. Hydrocarbon transfer system (1) according to claim 7, wherein the transfer line parts (35, 36, 39, 40) comprise rigid pipes, the first transfer line part being connected to the support structure (2) via an articulation joint (33, 34) allowing rotation of the first transfer line (35, 36) part around a transverse axis relative to the support structure (2).

19. Hydrocarbon transfer system (1) according to claim 8, wherein the transfer line parts (35, 36, 39, 40) comprise rigid pipes, the first transfer line part being connected to the support structure (2) via an articulation joint (33, 34) allowing rotation of the first transfer line (35, 36) part around a transverse axis relative to the support structure (2).

* * * * *